US005791494A

United States Patent [19]

Meyer

[11] Patent Number: 5,791,494

[45] Date of Patent: Aug. 11, 1998

[54] SCREENING MACHINE WITH ACCELERATION-CONSTANT CONTROL

[75] Inventor: Hans Jürgen Meyer, Ratingen, Germany

[73] Assignee: F. Kurt Retsch GmbH & Co. KG, Haan, Germany

[21] Appl. No.: 670,875

[22] Filed: Jun. 28, 1996

[51] Int. Cl.[6] ..... B07B 1/42

[52] U.S. Cl. ..... 209/368; 209/365.3; 209/366

[58] Field of Search ..... 209/325, 326, 209/363, 364, 365.1, 365.3, 365.4, 366, 368; 73/570, 576, 579, 668

[56] References Cited

U.S. PATENT DOCUMENTS 3,158,256 11/1964 Torrey et al. ..... 209/368 X
3,650,401 3/1972 Riesbeck et al. ..... 209/368 X

FOREIGN PATENT DOCUMENTS 4012902 4/1991 Germany .
1553196 3/1990 U.S.S.R. ..... 209/368

*Primary Examiner*—William E. Terrell
*Assistant Examiner*—Tuan N. Nguyen
*Attorney, Agent, or Firm*—Robert W. Becker & Associates

[57] ABSTRACT

In a screening machine with a three-dimensional oscillating screening movement and a control unit for converting a given vibration level into the required energy supply for the electromagnet, the results of screening analyses are to be reproducible or comparable; to this end it is provided that the control unit (26) is designed for calculating the machine acceleration as a function of the respective determined vibration level and the simultaneously determined frequency value as a control value for the energy supply to the electromagnet and for the setpoint-actual value comparison of the calculated machine acceleration actual value with a given machine acceleration setpoint value and for compensating a determined machine acceleration deviation by adjusting the energy supply to the electromagnet (21) on the basis of the change in the vibration level calculated as a function of the given frequency.

14 Claims, 2 Drawing Sheets

SCREENING MACHINE WITH ACCELERATION-CONSTANT CONTROL

BACKGROUND OF THE INVENTION

The invention relates to a screening machine with a three-dimensional oscillating or spreading screening movement, with a support for the screen base, of which there is at least one, the screen support, which is displaceably arranged relative to the housing and is acted upon by a frequency-excited electromagnet, being supported via springs relative to the housing, and with a device for determining the vibration level of the screen support and furthermore with a control unit for converting a given vibration level into the required energy supply for the electromagnet.

A screening machine having the above features is described in DE 40 12 902 C1; in this specification, it is important for precision and in particular for the comparability of different screening analyses to be able to define the parameters of correct mesh width of the screen base according to DIN, analysis time, frequency of the screening movement and vibration level of the screening movement for analyses which are carried out and to be able to reproduce these parameters for further analyses. For this reason, the known screening machine comprises a device for determining the actual vibration level of the screening movement, in the described case an inductive path transmitter, and also a control unit for converting a given vibration level into the required energy supply for the electromagnet. This proposal is based on the notion that a precise adjustment of the vibration level is sufficient for the definition and reproducibility of screening analyses, with the parameters otherwise remaining unchanged.

This notion is based upon the fact that generic-type screening machines, i.e., the aforementioned type, are usually constructed as resonance screening machines, which are excited by the respective mains or line frequency with the aid of a phase-shifting control. Since it is possible in this case to proceed from a constant excitation frequency, it is possible to merely vary the vibration level by changing the voltage of the energy supply to the electromagnet in order to obtain an operating mode which is as expedient as possible.

Since mains frequencies of 50 Hz or 60 Hz are usual for the excitation of screening machines, generic-type screening machines are adapted to the above mains frequencies by the design of their spring-mass system. It has been disadvantageously found, however, that in spite of the precisely adjusted constant vibration level, the results of screening analyses carried out with otherwise like parameters differ from one another between screening machines adapted to 50 Hz mains frequency and 60 Hz mains frequency.

It is therefore the object of the invention to dispense with this shortcoming in a generic-type screening machine and to render the results of screening analyses of different screening machines reproducible or comparable.

SUMMARY OF THE INVENTION

The solution of this object is realized by a control unit that is designed for calculating the acceleration of the machine as a function of the respective determined vibration level and of the simultaneously determined frequency value as a control value for the energy supply to the electromagnet, for the setpoint/actual value comparison of the calculated machine acceleration actual value with a given machine acceleration setpoint value, and for compensating a determined machine acceleration deviation by adjusting the energy supply to the electromagnet on the basis of the change in the vibration level calculated as a function of the given frequency. Alternatively, an acceleration sensor can be provided for determining the actual acceleration value of the machine, with the control unit being designed for the setpoint/actual comparison of the machine acceleration actual value with a given machine acceleration setpoint value and for compensating a determined machine acceleration deviation by adjusting the vibration level, which is determined as a function of the given frequency and corresponds to the machine acceleration setpoint value, by adjusting the energy supply to the electromagnet.

The invention proceeds from the basic idea that the control unit is designed for calculating the machine acceleration as a function of the respective determined vibration level and the simultaneously determined frequency value as a control value for the energy supply to the electromagnet and for the setpoint-actual value comparison of the calculated machine acceleration actual value with a given machine acceleration setpoint value and for compensating a determined machine acceleration deviation by adjusting the energy supply to the electromagnet on the basis of the change in the vibration level calculated as a function of the given frequency.

The invention makes use of the knowledge that it is necessary to maintain a constant acceleration for the reproducibility or comparability of screening analyses; since a spring-mass system according to the generic-type screening machine of the invention presupposes a sinusoidal vibration path, the following mathematical equation applies for the respective existing machine acceleration:

$$e=a\times\omega^2$$

where e=machine acceleration a=vibration level

ω=angle velocity

The angle velocity ω is determined as follows:

$$\omega=2\times\pi\times f$$

where f=excitation frequency.

While only precisely determined or adjustable vibration levels are used as determining adjustment values for the comparability or reproducibility of screening analyses according to the teaching of the generic specification DE 40 12 902 C1, the above mathematical equation illustrates the large degree of influence which the actual frequency has in achieving a given machine acceleration, different machine accelerations therefore necessarily arise from the different mains frequencies. Here the invention provides a solution, since the design of the control unit of the invention ensures that actual values of both the vibration level and the frequency are determined and monitored and that a detected deviation of the machine acceleration calculated from the above values from the machine acceleration given as a setpoint value and fixed as the same for different analyses is converted into an adjustment of the energy supply to the electromagnet by changing or adapting the vibration level, at a given frequency, in order to attain the given machine acceleration setpoint value.

Associated with the invention is the advantage that it is only necessary to determine the preset values for the machine acceleration in order to ensure comparability or reproducibility in screening tests in different laboratories using screens made by different manufacturers and optionally using different mains frequencies. In this respect, errors resulting from different screening frequencies are compensated in each case by an automatic adjustment of the vibration level.

In an alternative embodiment of the invention, the acceleration uniformity of the screening analyses which are to be compared can also be ensured in that an acceleration sensor is provided for determining the machine acceleration actual value and the control unit is designed for a setpoint-actual value comparison of the machine acceleration actual value with a given machine acceleration setpoint value and for compensating a determined machine acceleration deviation by adjusting the vibration level determined as a function of the given frequency and corresponding to the machine acceleration setpoint value by adjusting the energy supply to the electromagnet. In this embodiment of the invention, the actual machine acceleration is measured by means of the acceleration sensor, if there is a deviation between the setpoint value and the actual value, then the vibration level required for attaining the machine acceleration setpoint value is determined in the control unit as a function of the respective existing frequency and this determined vibration level is then set by adjusting the energy supply to the electromagnet, so that the machine acceleration setpoint value is set as a reference value for the screens with like acceleration during the course of the screening analysis.

In addition, oscillating screening machines having inherent frequency excitation are already known; in this case the excitation frequency is varied, the vibration level increasing as the excitation frequency approaches the load-dependent inherent frequency of the screening machine. If the vibration level is to be reduced, this is effected by adjusting a difference between the excitation frequency and the inherent machine frequency. Advantages of this type of inherent frequency excitation are the independence of the excitation frequency from the known 50 Hz or 60 Hz mains frequencies, as well as minimum power consumption and high loading capacity of the screening machines. However, even with machines which are excited by inherent frequency, only the vibration level is displayed.

The invention can also be advantageously applied to oscillating screening machines which are excited by inherent frequency in that, according to an embodiment of the invention, an inherent frequency control is provided for the excitation of the electromagnet, an inherent frequency control preferably also being integrated in the control unit for calculating the machine acceleration. Since different excitation frequencies are necessarily produced in inherent frequency-excited screening machines of this type at the same vibration levels as a result of machine tolerances such as internal mass tolerances or spring deflection tolerances and as a result of different analysis screen weights or in particular the use of different numbers of fitted screens, so that constantly changing values for the machine acceleration (e) would be derived during the course of the analysis, the control unit according to the invention for providing acceleration-constant control in combination with inherent frequency excitation is associated with the advantage that both the actual values of the vibration level and frequency are determined, monitored and adjusted in order to achieve a constant machine acceleration.

According to an embodiment of the invention, the control unit comprises a keyboard for inputting the machine acceleration setpoint value. In a further embodiment of the invention, the control unit can also comprise a display for the given frequency for control and comparison purposes.

In a particular embodiment of the invention, a so-called automatic knocking means is provided in order to release any jammed grain from the screen mesh of the analysis screen. To this end, it is provided that the control unit is designed for briefly supplying sufficient excitation current to the magnetic gap formed between the armature and the magnet yoke. As a result of the corresponding actuation of the electromagnet, the armature strikes the magnet yoke forcefully, so that this mechanical movement produces the desired knocking effect. This offers the advantage in screening machines with inherent frequency excitation and acceleration-constant control that comparatively slight changes in the field strength of the magnet are sufficient to produce temporarily increased vibration levels which are sufficient for overcoming the magnetic gap, the size of which is dependent upon the make. This subjection provided according to the invention of the control operation and current supply of the magnet to increased power only needs to be carried out for a short interval of, for example, less than 0.5 s, before the control unit again takes over the acceleration-constant control of the screening machine.

According to an embodiment of the invention, the control unit supplies the electromagnet with a corresponding excitation current during prescribed intervals.

In order to protect the magnet and the screening machine from mechanical damage resulting from the knocking effect, it is possible to insert an elastic damping member between the armature and the screen support.

BRIEF DESCRIPTION OF THE DRAWINGS

An embodiment, which is described in the following, is reproduced in the drawings, in which.

DESCRIPTION OF PREFERRED EMBODIMENTS

Figure 1:
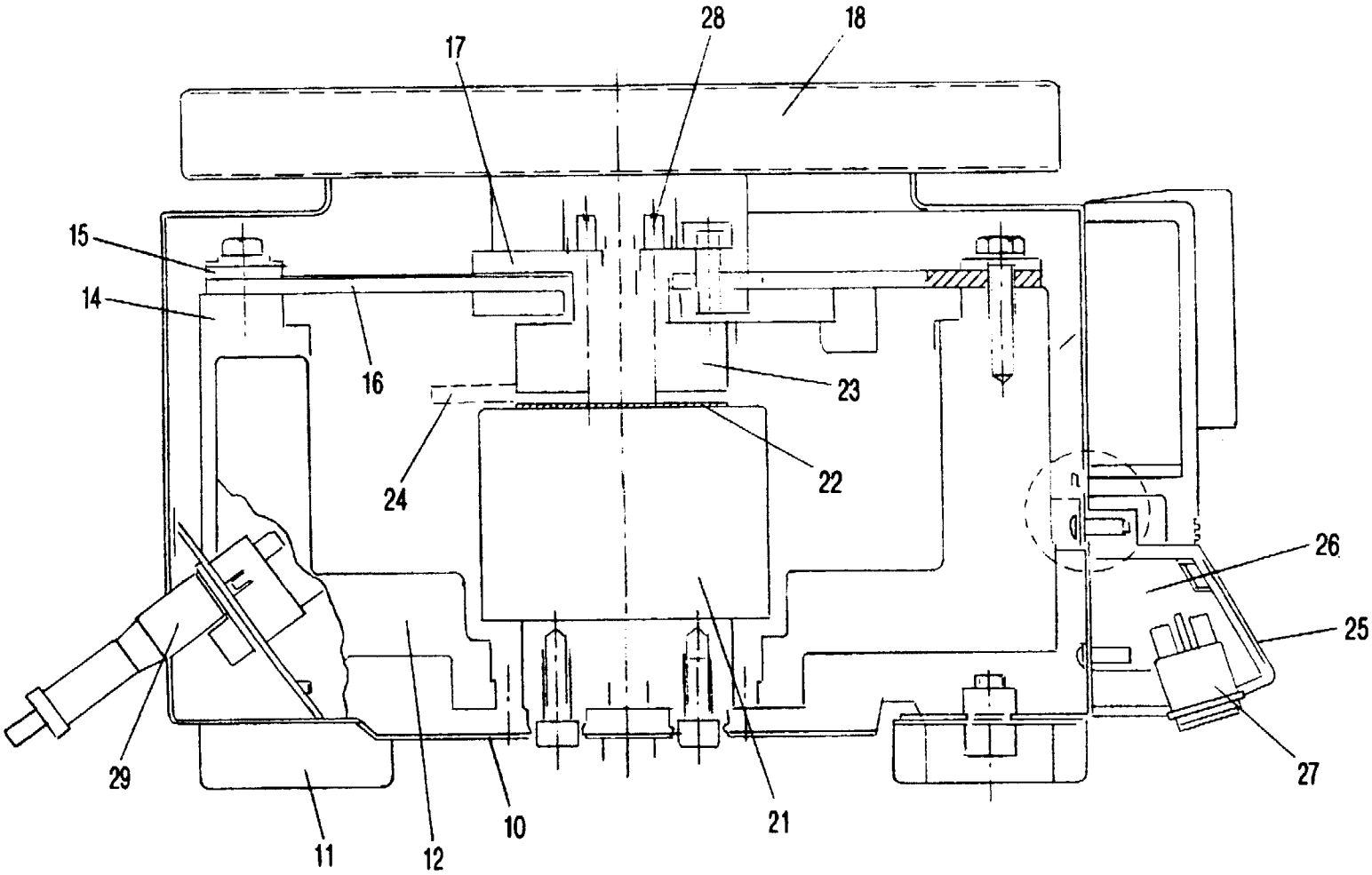
FIG. 1 is a side view of a screening machine, partially shown in section.
Figure 2:
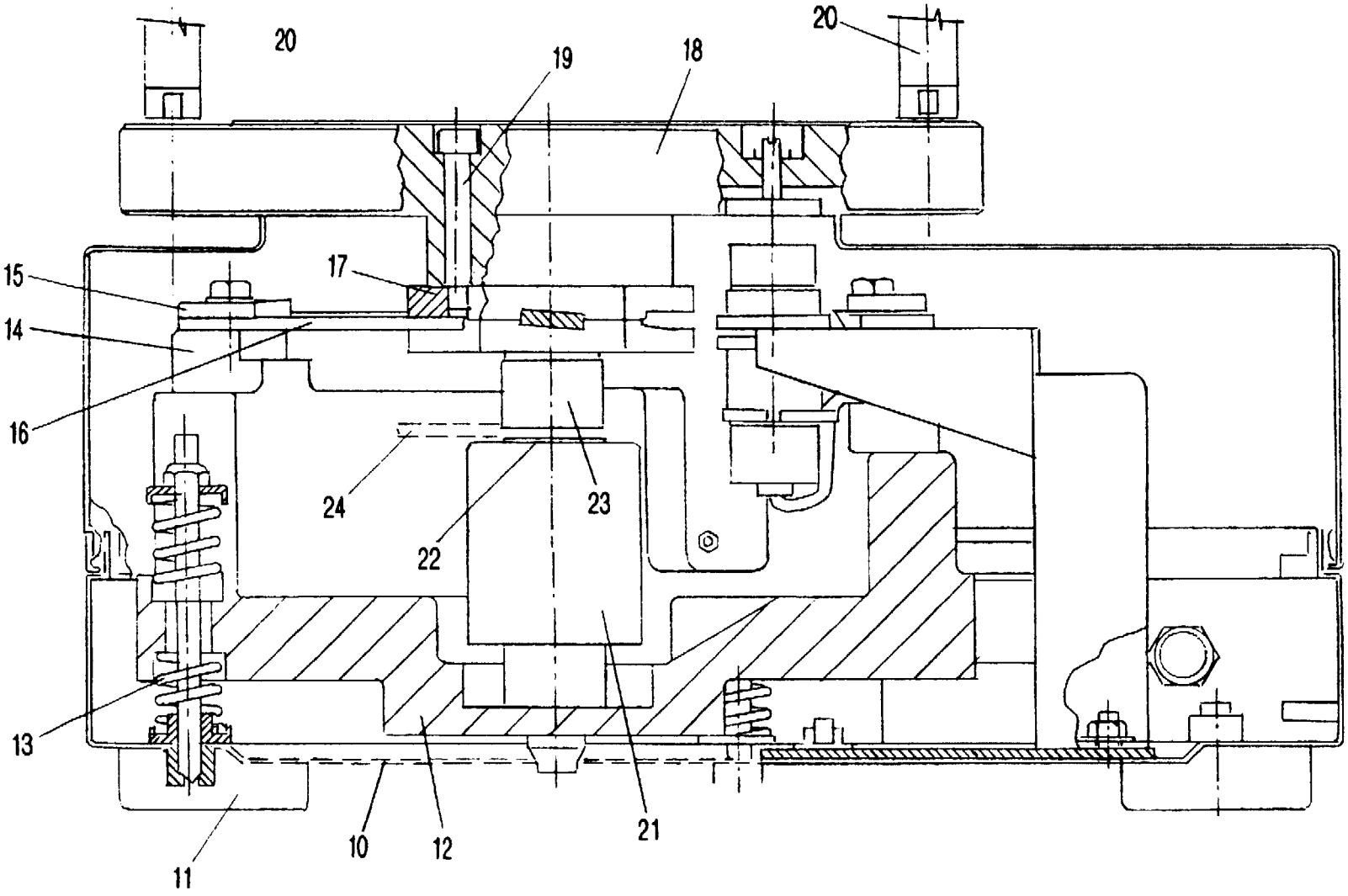
FIG. 2 shows the screening machine according to FIG. 1 in a view or section rotated through 90°.

Arranged on springs 13 in a housing 10 provided with feet 11 is a counter mass 12 acting as a support for the drive or of a screen support for damping vibrations which are generated by the drive or by the screen tower mounted on the screen support and which act upon the housing 10.

Mounted at the upper end of the pot-like counter mass 12 are bearings or support means 14, which are distributed over the circumference and comprise settings or clamping means 15 for radially extending, star-shaped leaf springs 16. At their other ends, the leaf springs 16 are secured internally in a clamping block 17, the clamping block 17 being connected by means of screws 19 to a screen support 18 resting thereon; the screen support 18 is used for holding analysis screens, not shown in detail, as is described in detail in DE 40 12 902 C1, which forms the basis of the generic type. To this end, securing means 20 are constructed on the screen support.

For driving the screening machine, an electromagnet 21 is arranged inside the pot-like counter mass 12. The magnet yoke or frame 22 faces the clamping block 17 and an armature 23 is arranged on the underside of the clamping block 17 facing the magnet yoke 23. A magnetic gap 24, whose dimensions are recommended by the magnet manufacturer, lies between the magnet yoke 22 and the armature 23. In addition, an elastic damping member 28 is arranged between the armature 23 and the screen support 18.

Arranged on the external housing 10 is a control unit 26 with an operating panel 25; an on-off switch 27 and a current supply 29 are also provided.

During operation of the screening machine, the screen bases, not shown, are placed on the screen support 18 and are secured by the securing means 20. A machine acceleration setpoint or target value is preset via the control unit 26 and the electromagnet 21 is acted upon with energy as a function of the respective inherent frequency and the vibration level, the electromagnet 21 causing the spring-mass system of the counter mass 12 together with leaf springs 16, clamping block 17 and screen support 18 to vibrate; the inherent frequency control integrated in the control unit 26 ensures that the machine is excited to its inherent frequency and that the prescribed acceleration setpoint value is observed.

The control unit 26 also ensures that the screening machine is subjected to its control operation at given intervals during the screening time and the electromagnet 21 is acted upon with a current which is large enough for the armature 23 to overcome the magnetic gap 24 and to strike hard upon the magnet yoke 22. By way of the knocking effect generated in this manner, it is possible to remove any jammed grain from the screen mesh of the analysis screen. After this desired short knocking effect, the control unit 26 returns the screening machine to normal controlled operation. Insofar as the striking of the armature 23 on the magnet yoke 22 would bring about excessive mechanical loading, the damping member 28 becomes effective.

The features of the subject matter of this document disclosed in the above description, in the claims, abstract and drawings can be significant individually and in any combination in the realization of the invention in its different embodiments.

Therefore, the present invention is, of course, in no way restricted to the specific disclosure of the specification and drawings, but also encompasses any modifications within the scope of the apended claims.

I claim:

1. A screening machine having a three-dimensional spreading screening movement, said screening machine comprising:

a screen support for at least one screen base, said screen support being displaceably disposed relative to a housing and being acted upon by a frequency-excited electromagnet, and further being supported via springs relative to said housing;

a device for determining a vibration level of said screen support; and a control unit for converting a given vibration level into the required energy supply for said electromagnet, wherein said control unit is designed for calculating an acceleration of said machine as a function of the respective determined vibration level and of the simultaneously determined frequency value as a control value for said energy supply to said electromagnet, for a setpoint/actual value comparison of the calculated machine acceleration actual value with a given machine acceleration setpoint value, and for compensating a determined machine acceleration deviation by adjusting said energy supply to said electromagnet on the basis of the change in the vibration level calculated as a function of the given frequency.

2. A screening machine according to claim 1, which includes an inherent frequency control for exciting said electromagnet.

3. A screening machine according to claim 1, wherein said control unit includes an operating panel for inputting a machine acceleration setpoint value.

4. A screening machine according to claim 3, wherein said operating panel includes a display for said given frequency and said given vibration level.

5. A screening machine according to claim 1, wherein said control unit is designed for briefly supplying said electromagnet with an excitation current that is sufficient for overcoming a magnetic gap formed in said screening machine between an armature and a magnet yoke.

6. A screening machine according to claim 5, wherein said control unit effects said brief supply of said electromagnet with excitation current during predetermined intervals.

7. A screening machine according to claim 5, wherein a damping member is disposed between said armature and said screen support.

8. A screening machine having a three-dimensional spreading screening movement, said screening machine comprising:

a screen support for at least one screen base, said screen support being displaceably disposed relative to a housing and being acted upon by a frequency-excited electromagnet, and further being supported via springs relative to said housing;

a device for determining a vibration level of said screen support;

a control unit for converting a given vibration level into the required energy supply for said electromagnet; and an acceleration sensor for determining an actual acceleration value of said machine, wherein said control unit is designed for a setpoint/actual comparison of the machine acceleration actual value with a given machine acceleration setpoint value and for compensating a determined machine acceleration deviation by adjusting said vibration level, which is determined as a function of the given frequency and corresponds to the machine acceleration setpoint value, by adjusting the energy supply to said electromagnet.

9. A screening machine according to claim 8, which includes an inherent frequency control for exciting said electromagnet.

10. A screening machine according to claim 8, wherein said control unit includes an operating panel for inputting a machine acceleration setpoint value.

11. A screening machine according to claim 10, wherein said operating panel includes a display for said given frequency and said given vibration level.

12. A screening machine according to claim 8, wherein said control unit is designed for briefly supplying said electromagnet with an excitation current that is sufficient for overcoming a magnetic gap formed in said screening machine between an armature and a magnet yoke.

13. A screening machine according to claim 12, wherein said control unit effects said brief supply of said electromagnet with excitation current during predetermined intervals.

14. A screening machine according to claim 12, wherein a damping member is disposed between said armature and said screen support.

* * * * *

UNITED STATES PATENT AND TRADEMARK OFFICE

CERTIFICATE OF CORRECTION

PATENT NO. : 5,791,494

DATED : August 11, 1998

INVENTOR(S) : Hans Jürgen Meyer

It is certified that error appears in the above-indentified patent and that said Letters Patent is hereby corrected as shown below:

On the title page;

[30] Foreign Application Priority Data

June 28 1995 [DE] Germany..... 195 22 987.8

February 24, 1996 [DE] Germany.... 196 07 074.0

Signed and Sealed this

Twenty-first Day of September, 1999

*Attest:*

Q. TODD DICKINSON

*Attesting Officer*

*Acting Commissioner of Patents and Trademarks*